US005223662A

United States Patent [19]

Igenbergs et al.

[11] Patent Number: 5,223,662

[45] Date of Patent: Jun. 29, 1993

[54] ACCELERATOR

[75] Inventors: Eduard Igenbergs, Munich; Martin Rott, Oberschleissheim, both of Fed. Rep. of Germany

[73] Assignee: Igenwert GmbH, Munich, Fed. Rep. of Germany

[21] Appl. No.: 499,535

[22] PCT Filed: May 11, 1989

[86] PCT No.: PCT/EP89/00516

§ 371 Date: Aug. 15, 1990

§ 102(e) Date: Aug. 15, 1990

[87] PCT Pub. No.: WO90/05278

PCT Pub. Date: May 17, 1990

[30] Foreign Application Priority Data

Nov. 11, 1988 [DE] Fed. Rep. of Germany ..... 3838386

[51] Int. Cl.[5] ..... F41B 6/00

[52] U.S. Cl. ..... 89/8; 124/3

[58] Field of Search ..... 89/7, 8; 124/3; 313/143, 161

[56] References Cited

U.S. PATENT DOCUMENTS

| | | | |
|---|---|---|---|
| 1,244,844 | 10/1917 | Dodds | 313/143 |
| 2,783,684 | 3/1957 | Yoler | 89/8 |
| 2,872,846 | 2/1959 | Crozier | 89/7 |
| 3,148,587 | 9/1964 | Melhart | 89/8 |
| 3,500,123 | 3/1970 | Turner | 313/161 |
| 4,640,180 | 2/1987 | Rose | 89/8 |
| 4,658,699 | 4/1987 | Dahm | 89/8 |

FOREIGN PATENT DOCUMENTS

| | | | |
|---|---|---|---|
| 232594 | 8/1987 | European Pat. Off. | 89/8 |

OTHER PUBLICATIONS

Goldstein et al R, "The Maid System-Data Base and Design Issues", IEEE Transactions on Magnetics, vol. MAG-18, No. 1, Jan. 1982, pp. 105-114.

Igenbergs et al, "The TUM/LRT Electromagnetic Launchers," IEEE Transactions on Magnetics, vol. MAG.-22, No. 6, Nov. 1986, pp. 1336-1341.

Igenbergs, Eduard, "Ein Magnetogasdynamisher Beschleuniger für die Simulation von Mikrometeoroiden", Raumfahrtforschung, vol. 17, part 4, Jul.-Aug. 1973, pp. 175-181.

*Primary Examiner*—Stephen C. Bentley

*Attorney, Agent, or Firm*—Townsend and Townsend

[57] ABSTRACT

An accelerator is described which comprises an electrothermal accelerator and is preferably of two-stage design, with the first stage consisting of an electrothermal accelerator, in particular an electromagnetically amplified electrothermal accelerator, and with the second stage consisting of a light gas accelerator.

10 Claims, 6 Drawing Sheets

ACCELERATOR

The invention relates to an electrothermal accelerator.

A substantial feature of the invention lies in the fact that this electrothermal accelerator is electromagnetically amplified and this electromagnetic amplification is supplied with the same energy and operated with the same energy source as the electrothermal accelerator. In this way an additional energy source with a switch and electronic coupling circuit which would be needed for this purpose are avoided. The forms of the electromagnetic amplification which are explained here are so laid out that no switches are necessary.

Figure 1:
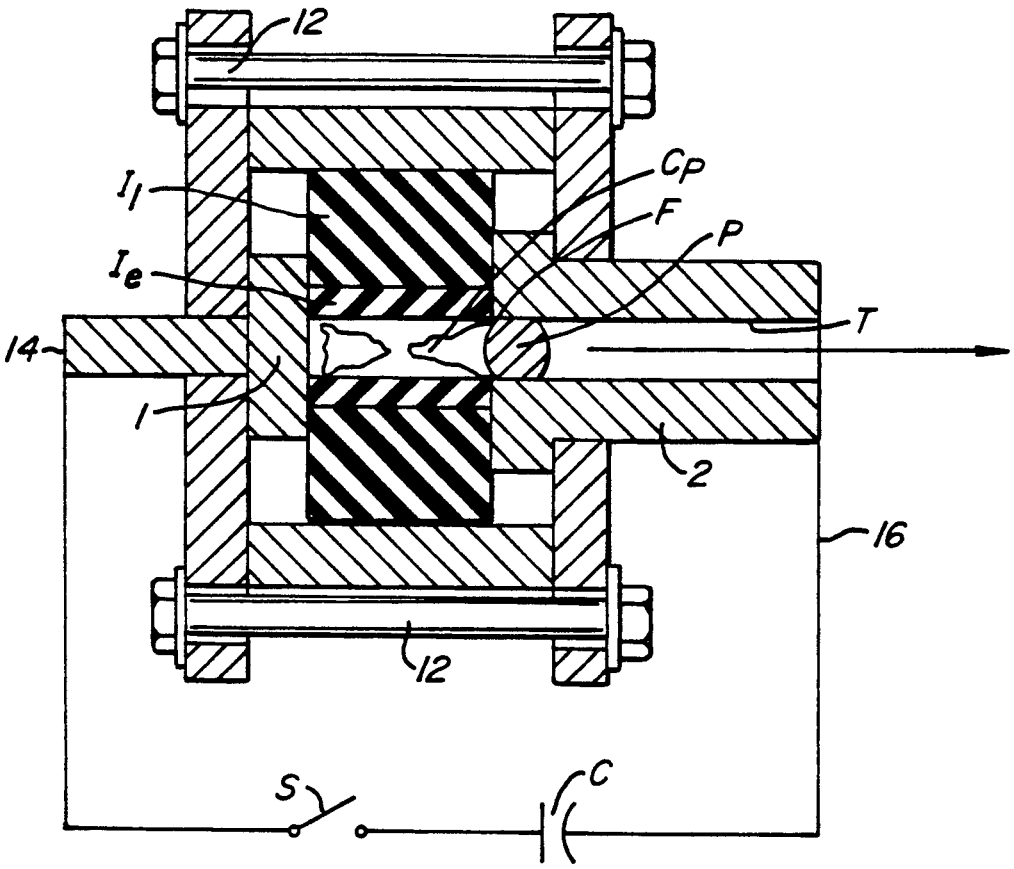
FIG. 1. (PRIOR ART)
FIG. 1 is a side elevation section of a prior art electrothermal accelerator.

The electrothermal accelerator in its simple form, as illustrated in FIG. 1, belongs to the prior art.

The discharge 14, 16 of a bank of capacitors C is directed via the switch S, which is preferably an ignition switch, to the electrode 1. A metal wire or a metal foil F is introduced between this electrode 1 and the electrode 2 between insulators $I_1$, $I_2$ and held together by bolts 12. On closing of the switch S this wire or foil F is heated up by the electrical current which is flowing, vaporised and ionised. A high temperature gas at a high pressure arises and is also termed a high pressure plasma. A material is preferably used here which has a low specific weight such as aluminium or lithium because only a little energy as possible need be expended for the acceleration of this gas. This high pressure plasma then expands into the pump tube T which starts at the electrode 2 and accelerates the projectile P therein.

Figure 2A:
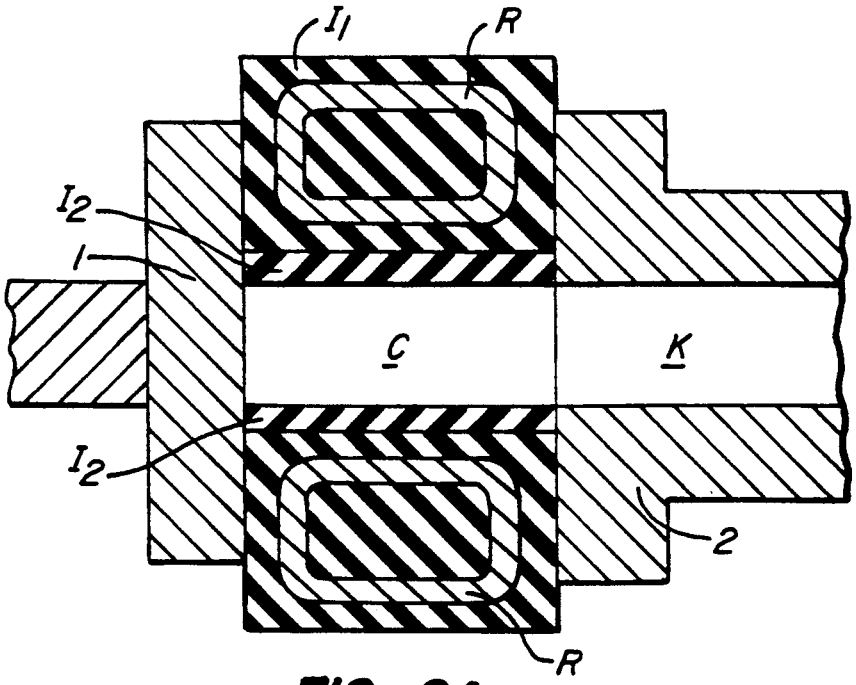
FIGS. 2A and 2B are respective side elevation and front elevation sections of an electrothermal accelerator according to this invention utilizing induction coils to electromagnetically amplify projectile emission in the primary chamber.
Figure 2B:
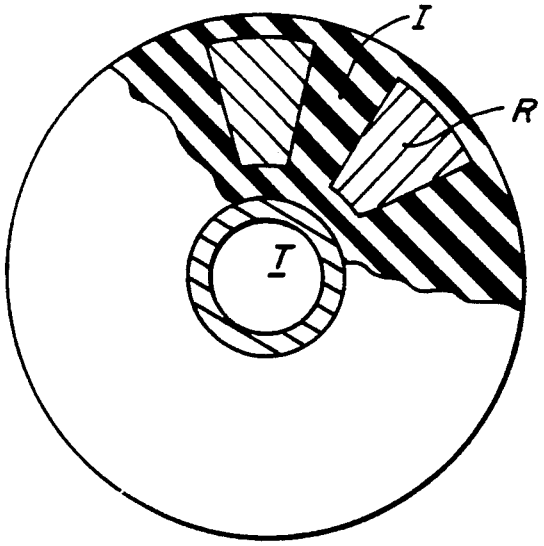

FIGS. 2A and 2B shows an electromagnetically amplified accelerator constructed in accordance with the invention.

The primary combustion chamber $C_P$ which is surrounded by a synthetic insulator I (plastic insulator) is located in the electrothermal accelerator. If one introduced closed conductive rings R into this synthetic insulator I, as shown in FIG. 2, then the flux of the azimuthal magnetic field which surrounds the current flowing from the electrode 1 to the electrode 2, and which varies in time in accordance with the frequency of the discharge of the bank of capacitors, generates a current in these conductor rings R. This ring current then generates, via an electromagnetic field which varies timewise, an additional and extended compression of the high pressure plasma between the electrode 1 and the electrode 2 which is termed "theta pinch" and which improves the efficiency of the accelerator through the inductive amplification.

Figure 3:
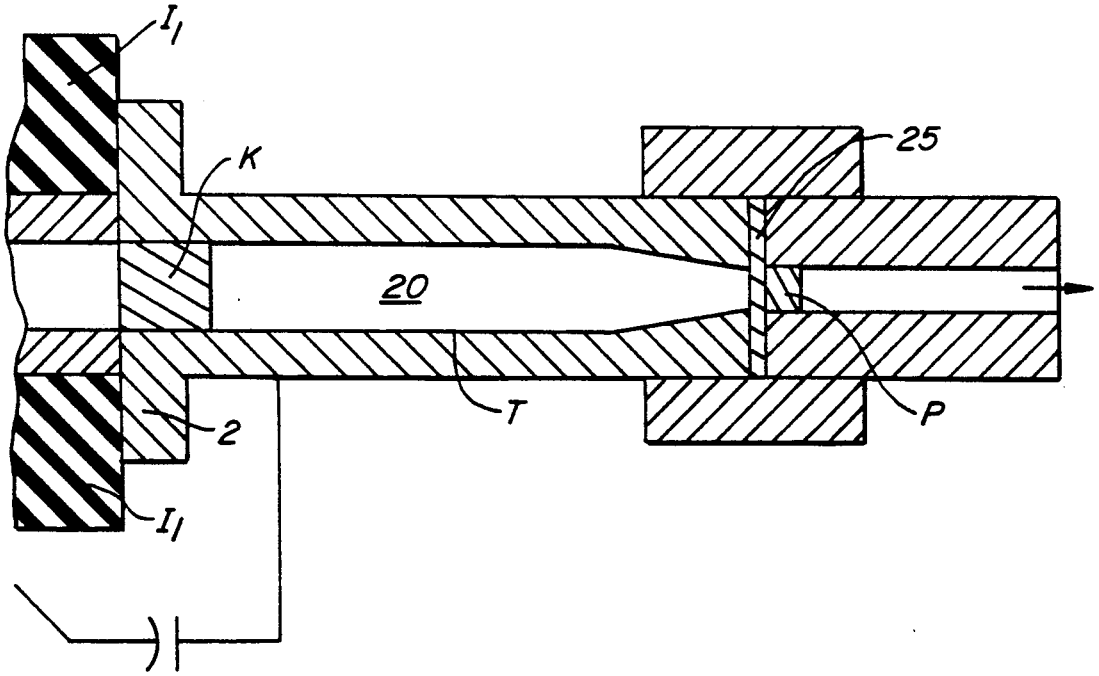
FIG. 3 is a side elevation section of a secondary acceleration chamber continued from the detail of FIG. 2A utilizing a burstable membrane with projectile to give final acceleration to a projectile from electrothermal light gas accelerator.

In accordance, with the representation in FIG. 3 the second stage C2 of the electrothermal light gas accelerator comprises a light gas accelerator with the barrel of the electrothermal accelerator being used as a pump tube T. The accelerated piston K moves into the pump tube T which is filled with a gas of low specific weight and high pressure 20. Hydrogen or helium is preferably used here. The piston compresses this high pressure gas which then bursts the membrane 25 mounted at the end of the pump tube. This high pressure gas then enters into the barrel of the light gas accelerator and accelerates the projectile P which has been introduced there. The advantage of this arrangement is that it is only necessary to accelerate a gas of low specific weight, namely hydrogen or helium, in order to accelerate the projectile. In this way less energy is expended for the acceleration of the gas and more energy remains for accelerating the projectile.

Figure 4A:
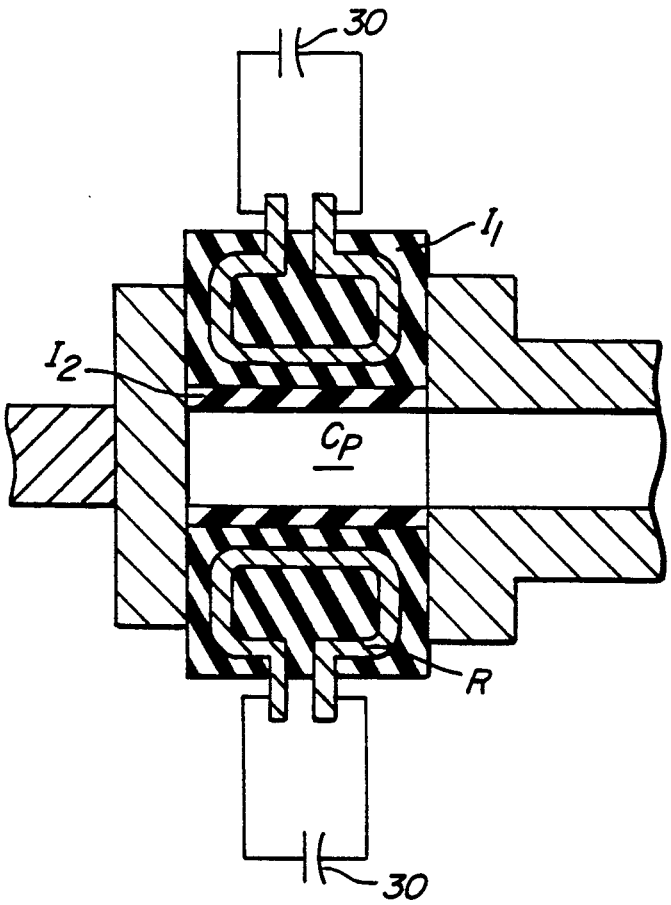
FIGS. 4A and 4B are respective side elevation and front elevation sections of a primary chamber similar to FIGS. 2A and 2B utilizing an induction coil and capacitor for amplification of projectile acceleration from the primary chamber.
Figure 4B:
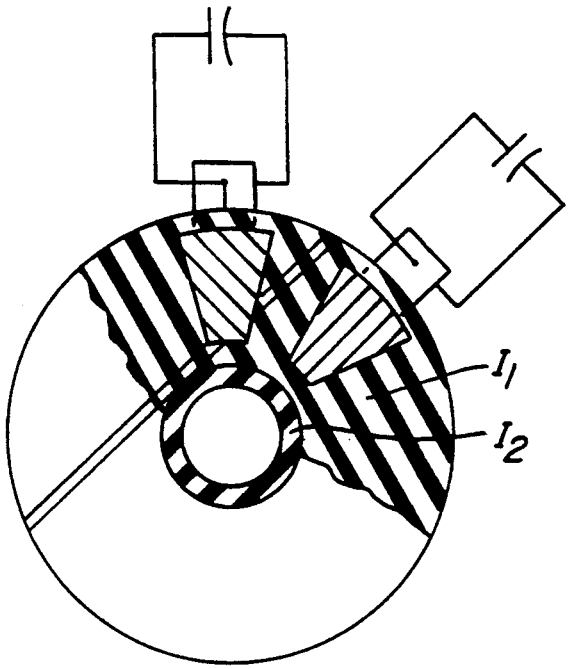

FIGS. 4A and 4B shows an advantageous embodiment in which the inductively coupled amplification illustrated in FIGS. 2A and 2B is so executed that each individual winding R which is used for the inductive amplification is formed as an RLC circuit by connection to capacitors 30.

In this way matching of the electromagnetic amplification can be achieved via a change of the phase and amplitude and also the frequency of these RLC circuits. This leads to an ideal arrangement of the total apparatus, both in a one-stage embodiment and also in a two-stage embodiment.

Figure 5A:
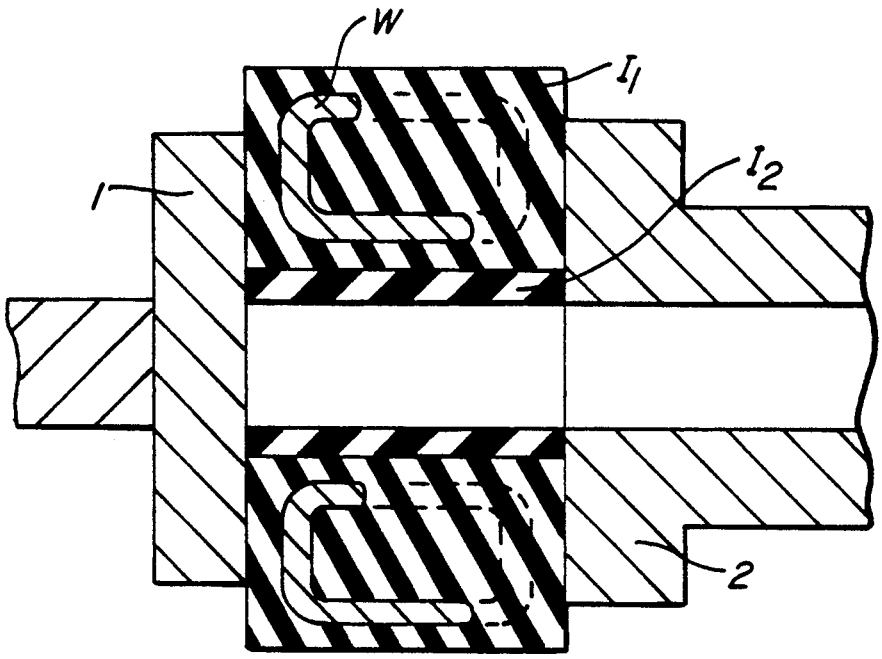
FIGS. 5A and 5B are respective side elevation and front elevation sections of a primary chamber similar to FIGS. 2A and 2B utilizing a single induction coil spirally wound with a plurality of windings about the primary chamber for amplification of projectile acceleration from the primary chamber.
Figure 5B:
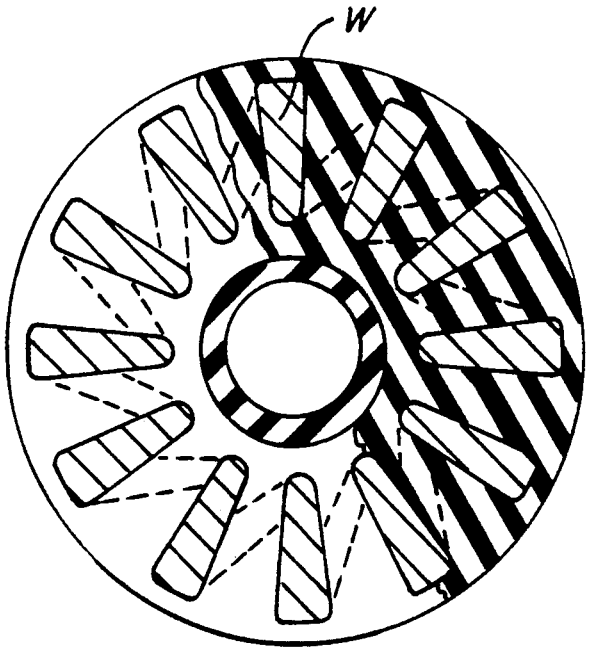

FIGS. 5A and 5B shows a further advantageous embodiment of the invention in which the coil which brings about the inductive coupling comprises a plurality of windings W. The electromagnetic amplification can in particular be carried out with a single coil with a plurality of windings which is arranged toroidally around the discharge chamber of the electrothermal accelerator.

Figure 6A:
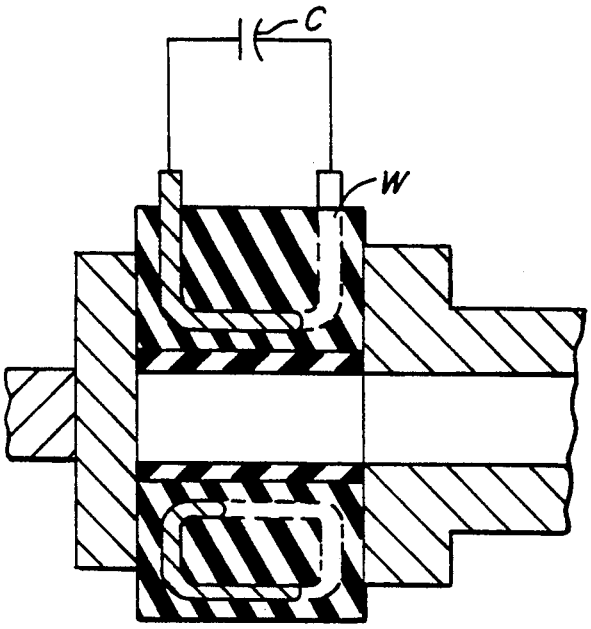
FIGS. 6A and 6B are respective side elevation and front elevation sections of a primary chamber similar to FIGS. 2A and 2B utilizing a single induction coil spirally wound connected to a capacitor for amplification of projectile acceleration from the primary chamber.
Figure 6B:
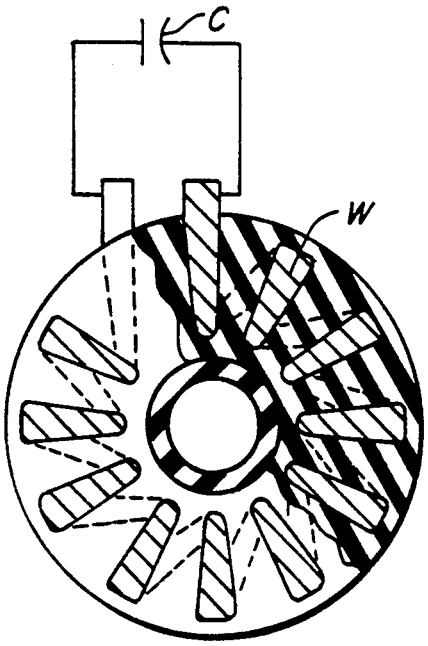

FIGS. 6A and 6B shows an advantageous layout of the invention in accordance with which the coil is again formed as part of an RLC circuit.

Figure 7A:
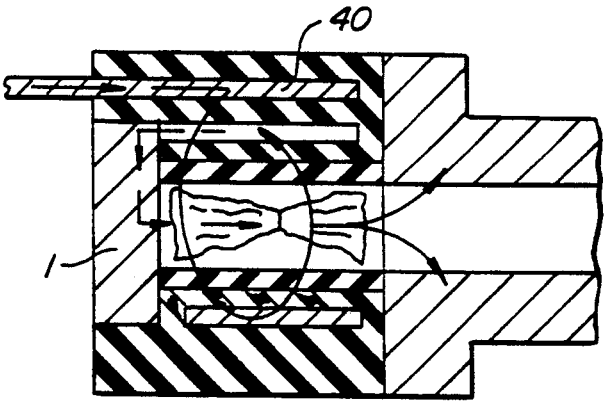
FIGS. 7A and 7B are respective side elevation and front elevation sections of a primary chamber similar to FIGS. 2A and 2B utilizing a circuit connected for the conventional actuation of the primary chamber connected through an induction coil for amplification of projectile acceleration from the primary chamber.
Figure 7B:
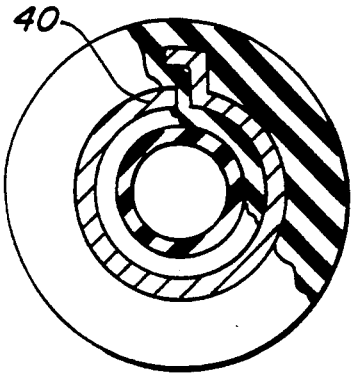
Figure 8A:
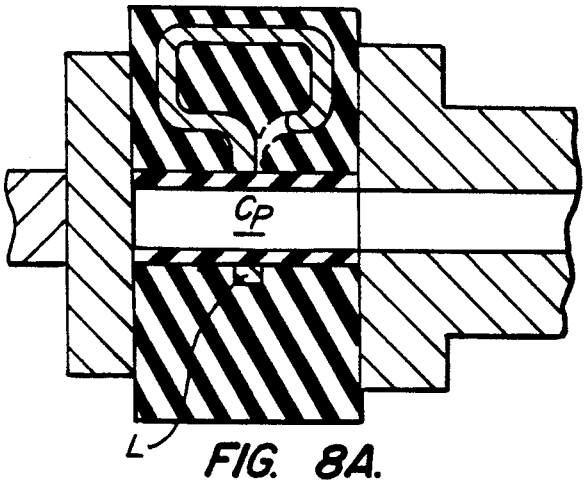
FIGS. 8A and 8D are respective side elevation and front elevation sections of a primary chamber similar to FIGS. 2A and 2B utilizing an induction coil and with a primary chamber barrel wrapping loop for amplification of projectile acceleration from the primary chamber.
Figure 8D:
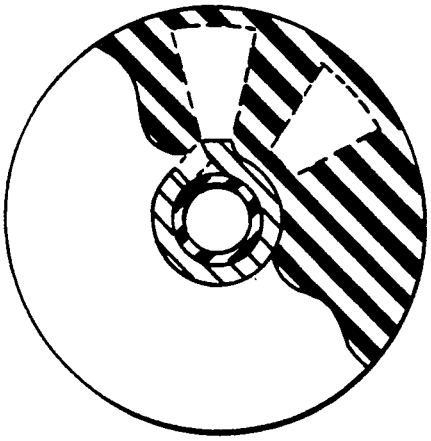
Figure 8B:
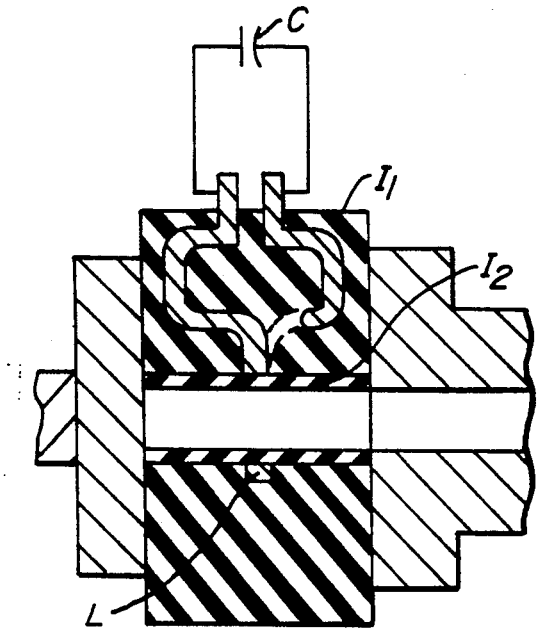
FIGS. 8B and 8E are respective side elevation and front elevation sections of a primary chamber similar to FIGS. 8A and 8D utilizing an induction coil and with a primary chamber barrel wrapping loop for amplification of projectile acceleration from the primary chamber, the inductive coil here being shown connected across a capacitor; and, FIGS. 8C and 8F are respective side elevation and front elevation sections of a primary chamber similar to FIGS. 8A and 8D utilizing a continuous induction coil with connected capacitor having a primary chamber barrel wrapping loop for amplification of projectile acceleration from the primary chamber.
Figure 8E:
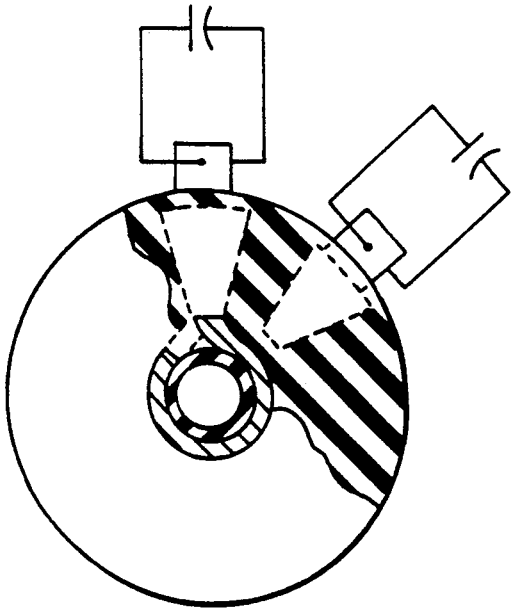
Figure 8C:
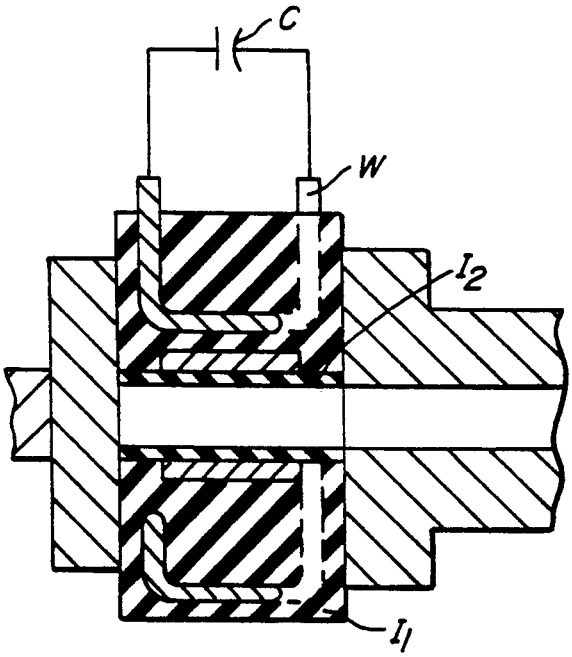
Figure 8F:
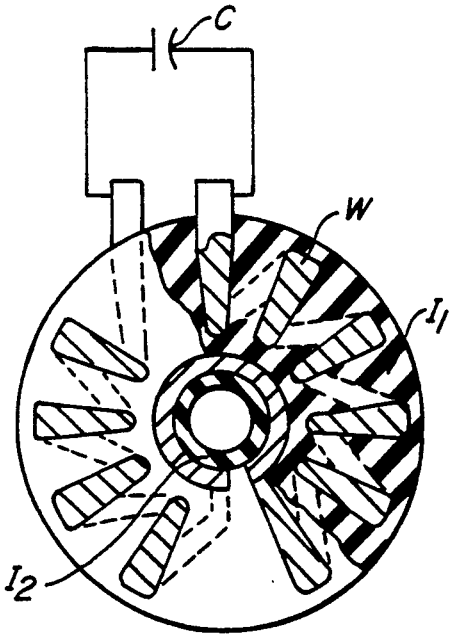

FIGS. 7A and 7B shows a further advantageous embodiment of the invention in which the current to the rear electrode 1 of this electrothermal accelerator is so directed that it passes through a coil 40 at least one winding which surrounds the combustion chamber of the electrothermal accelerator. The electromagnetic field generated by this coil which varies in time brings about a magnetogasdynamic compression of the plasma arising in the combustion chamber (theta pinch) and thus an electromagnetic amplification of the accelerator.

The electrothermal light gas accelerator consists in each case of an electrothermal first stage, which comprises a simple electrothermal accelerator, preferably however an electromagnetically amplified electrothermal accelerator as has been described above with reference to the various variants, and a light gas accelerator as the second stage. In the latter case the arrangement is the same as was set forth in FIG. 3 for the simple electrothermal accelerator to which must be added the respectively used embodiment of the electrothermal amplification as illustrated in FIGS. 2A, 2B, 4A, 4B, 5A, 5B, 6A, 6B, 7A and 7B.

FIGS. 8A–8F show an embodiment of the accelerator in which the electric current which is induced by the magnetic field which generates an arc extending in the combustion chamber $C_P$ is directed through a conductor loop L which surrounds the combustion chamber in ring-like manner. The current in this conductor loop L which changes with time generates an oppositely directed current in the arc plasma in the combustion chamber. The interaction of the current in the ring-like conductor loop with the induced ring current in the arc plasma brings about an axial acceleration of the arc plasma and thus an additional acceleration of the projectile and an improved degree of efficiency of the accelerator.

The electromagnetic amplification thus takes place as already explained either directly in that the current supply or extraction is exploited to generate a magnetic field which varies timewise (see FIGS. 7A and 7B), or inductively with the magnetic field of the arc discharge in the combustion chamber of the accelerator generating a current in a secondary coil, with the current being exploited for electromagnetic amplification (see FIGS. 2A, 2B, 4A, 4B, 5A, 5B, 6A, 6B, 8A–8F.

With an inductive amplification the action of the current induced into the secondary coil must either take place from this secondary coil or from a current loop which is fed by this secondary coil. This current loop is arranged at a suitable position around the combustion chamber. The current which changes with time and which flows through this conductor loop generates a predominantly axial magnetic field at the location of the primary arc in the combustion chamber and the time change of this magnetic field leads to a ring current which flows in the same plane as the current in the conductor loop but is oppositely directed to the latter. Both current loops are repelled and an axial force acting on the arc plasma results which additionally accelerates the plasma and thus brings about an amplification (enhancement) of the projectile acceleration. This arrangement can lead from one secondary loop to a conductor loop, from one secondary coil torus to a conductor loop and also to several conductor loops arranged along the plasma flow.

In all these case it is to be expected that the acceleration of the projectile is amplified, this would correspond in the gas dynamic model to an arrangement with a "co-moving combustion chamber".

We claim:

1. In an electrothermal accelerator having:

a chamber for accelerating a projectile along an axis, said chamber including;

a first electrode closing one end of said chamber;

a bore communicated to said chamber about said axis for permitting gas within said chamber to escape said chamber and propel a projectile in the bore;

a second electrode adjacent the entrance to said bore;

dielectric material placed between said electrodes defining a combustion chamber communicated to said bore for discharging gas heated between said first and second electrodes to said bore;

metal placed between said first and second electrodes in the chamber for being vaporized and/or ionized for creating said gas for propelling said projectile;

means for communicating electrical current to said electrodes for vaporizing or ionizing said metal;

the improvement to said electrothermal accelerator comprising in combination:

a coil having at least one winding in electromagnetic communication with electrical current in said chamber between said electrodes for receiving magnetically induced current from current discharge between said electrodes, said coil aligned with respect to said axis of acceleration of said projectile whereby said gas discharge is amplified by said magnetic field from said current in said coil.

2. The electrothermal accelerator of claim 1 and including:

a capacitor is communicated in series to said coil.

3. The electrothermal accelerator of claim 1 and wherein:

said coil has more than one winding.

4. The electrothermal accelerator of claim 3 and wherein:

a capacitor is communicated to said coil.

5. The electrothermal accelerator of claim 1 and wherein:

said coil is wound in a toroidal manner about said axis.

6. The electrothermal accelerator of claim 1 and wherein:

a piston is disposed between said chamber and said projectile; said piston disposed form movement along said bore toward said projectile to propel said projectile.

7. The electrothermal accelerator of claim 1 and further including:

a secondary chamber filled with high pressure gas;

a piston in communication with said chamber on one side and said secondary chamber on the other side and moveable along an axis which is aligned parallel to said axis of said electrothermal accelerator;

a burstable membrane closing said secondary chamber for confining said high pressure gas, said membrane communicated to said primary chamber for having said gas from said primary chamber burst said membrane permitting said high pressure gas to assist in the propulsion of said projectile.

8. In an electrothermal accelerator having:

a chamber for accelerating a projectile along an axis, said chamber including;

a first electrode closing one end of said chamber;

a bore about said axis and communicated with said chamber for permitting gas within said chamber to escape said chamber and propel a projectile within said bore;

a second electrode adjacent the entrance to said bore;

dielectric material placed between said electrodes defining a combustion chamber communicated to said bore for discharging gas heated between said first and second electrodes to said bore;

metal placed between said first and second electrodes for being vaporized and/or ionized for creating said gas for propelling said projectile;

means for communicating electrical current to said electrodes for vaporizing or ionizing said metal;

the improvement to said electrothermal accelerator comprising in combination:

a coil having at least one winding in series communication with electrical current in said chamber between said electrodes for receiving current through said coil during discharge between said electrodes, said coil aligned with respect to said axis of acceleration of said projectile whereby said gas discharge is amplified by said magnetic field from said coil.

9. The electrothermal accelerator of claim 8 and wherein:

a piston is disposed between said chamber and said projectile; said piston disposed form movement along said bore toward said projectile to propel said projectile.

10. The electrothermal accelerator of claim 8 and further including:

a secondary chamber filled with high pressure gas;

a piston in communication with said chamber on one side and said secondary chamber on the other side and moveable along an axis which is aligned parallel to said axis of said electrothermal accelerator;

a burstable membrane closing said secondary chamber for confining said high pressure gas, said membrane communicated to said primary chamber for having said gas from said primary chamber burst said membrane permitting said high pressure gas to assist in the propulsion of said projectile.

* * * * *